US005264866A

United States Patent [19]

Nagahisa

[11] Patent Number: 5,264,866

[45] Date of Patent: Nov. 23, 1993

[54] THERMAL PRINTER CONTROL APPARATUS EMPLOYING THERMAL CORRECTION DATA

[75] Inventor: Hideo Nagahisa, Hiroshima, Japan

[73] Assignee: Mitsubishi Denki K.K., Tokyo, Japan

[21] Appl. No.: 645,514

[22] Filed: Jan. 24, 1991

[30] Foreign Application Priority Data

Jan. 26, 1990 [JP] Japan ..... 2-14883

[51] Int. Cl.[5] ..... B41J 2/36; B41J 2/325

[52] U.S. Cl. ..... 346/76 PH

[58] Field of Search ..... 346/76 PH; 400/120

[56] References Cited

U.S. PATENT DOCUMENTS

| | | | |
|---|---|---|---|
| 4,364,063 | 12/1982 | Anno et al. | 346/76 PH |
| 4,464,669 | 8/1984 | Sekiya et al. | 346/76 PH |
| 4,567,488 | 1/1986 | Moriguchi et al. | 346/76 PH |
| 4,574,293 | 3/1986 | Inui et al. | 346/76 PH |
| 4,590,487 | 5/1986 | Noguchi et al. | 346/76 PH |

FOREIGN PATENT DOCUMENTS

| | | |
|---|---|---|
| 0304916 | 3/1989 | European Pat. Off. . |
| 63-319163 | 12/1988 | Japan . |

OTHER PUBLICATIONS

Patent Abstracts of Japan, Section M, Section No. 524, vol. 10, No. 299, p. 133.

*Primary Examiner*—Benjamin R. Fuller
*Assistant Examiner*—Huan Tran
*Attorney, Agent, or Firm*—Sughrue, Mion, Zinn, Macpeak & Seas

[57] ABSTRACT

A printer, which is improved in print quality, comprises first storage means for storing at least data on dots adjacent to an aimed dot on a line to be printed; second storage means for storing data on aimed dots on the line immediately before the line to be printed and on the line located two line before the line to be printed, and at least data on dots adjacent to the aimed dots on the line immediately before the line to be printed and the line located two lines before the line to be printed; third storage means for storing correcting data formed according to the data stored by the first and second storage means; and control means for controlling the energization time of the aimed dot on the line to be printed, according to the correcting data.

2 Claims, 16 Drawing Sheets

FIG. 3A

7A

| $RD_0$ | $RD_1$ | $RD_2$ | $RD_3$ | $RD_4$ | $RD_5$ | $RD_6$ | $RD_7$ |
|---|---|---|---|---|---|---|---|
| HDI 1 (T3) | HDI 1 (T3) | HDI 1 (T2) | HDI 1 (T2) | HDI 1 (T1) | HDI 1 (T1) | HDI 1 ($\ell$-2) | HDI 1 ($\ell$-1) |
| HDI 2 (T3) | HDI 2 (T3) | HDI 2 (T2) | HDI 2 (T2) | HDI 2 (T1) | HDI 2 (T1) | HDI 2 ($\ell$-2) | HDI 2 ($\ell$-1) |
| HDI 3 (T3) | HDI 3 (T3) | HDI 3 (T2) | HDI 3 (T2) | HDI 3 (T1) | HDI 3 (T1) | HDI 3 ($\ell$-2) | HDI 3 ($\ell$-1) |
| HDI 4 (T3) | HDI 4 (T3) | HDI 4 (T2) | HDI 4 (T2) | HDI 4 (T1) | HDI 4 (T1) | HDI 4 ($\ell$-2) | HDI 4 ($\ell$-1) |
| HDI 5 (T3) | HDI 5 (T3) | HDI 5 (T2) | HDI 5 (T2) | HDI 5 (T1) | HDI 5 (T1) | HDI 5 ($\ell$-2) | HDI 5 ($\ell$-1) |
| HDI 6 (T3) | HDI 6 (T3) | HDI 6 (T2) | HDI 6 (T2) | HDI 6 (T1) | HDI 6 (T1) | HDI 6 ($\ell$-2) | HDI 6 ($\ell$-1) |
| HDI 7 (T3) | HDI 7 (T3) | HDI 7 (T2) | HDI 7 (T2) | HDI 7 (T1) | HDI 7 (T1) | HDI 7 ($\ell$-2) | HDI 7 ($\ell$-1) |
| HDI 8 (T3) | HDI 8 (T3) | HDI 8 (T2) | HDI 8 (T2) | HDI 8 (T1) | HDI 8 (T1) | HDI 8 ($\ell$-2) | HDI 8 ($\ell$-1) |

FIG. 3B

7B

| $PLD_0$ |
|---|
| HDI 1 ($\ell$) |
| HDI 2 ($\ell$) |
| HDI 3 ($\ell$) |
| HDI 4 ($\ell$) |
| HDI 5 ($\ell$) |
| HDI 6 ($\ell$) |
| HDI 7 ($\ell$) |
| HDI 8 ($\ell$) |

FIG. 4(a)

7A

| $RD_0$ | $RD_1$ | $RD_2$ | $RD_3$ | $RD_4$ | $RD_5$ | $RD_6$ | $RD_7$ | |
|---|---|---|---|---|---|---|---|---|
| $R_1$ (T3) | $R_1$ (T3) | $R_1$ (T2) | $R_1$ (T2) | $R_1$ (T1) | $R_1$ (T1) | $R_1$ ($\ell$-2) | $R_1$ ($\ell$-1) | HDI1 |
| $R_2$ (T3) | $R_2$ (T3) | $R_2$ (T2) | $R_2$ (T2) | $R_2$ (T1) | $R_2$ (T1) | $R_2$ ($\ell$-2) | $R_2$ ($\ell$-1) | |
| $R_3$ (T3) | $R_3$ (T3) | $R_3$ (T2) | $R_3$ (T2) | $R_3$ (T1) | $R_3$ (T1) | $R_3$ ($\ell$-2) | $R_3$ ($\ell$-1) | |
| ⋮ | ⋮ | ⋮ | ⋮ | ⋮ | ⋮ | ⋮ | ⋮ | |
| ⋮ | ⋮ | ⋮ | ⋮ | ⋮ | ⋮ | ⋮ | ⋮ | |
| $R_{255}$ (T3) | $R_{255}$ (T3) | $R_{255}$ (T2) | $R_{255}$ (T2) | $R_{255}$ (T1) | $R_{255}$ (T1) | $R_{255}$ ($\ell$-2) | $R_{255}$ ($\ell$-1) | |
| $R_{256}$ (T3) | $R_{256}$ (T3) | $R_{256}$ (T2) | $R_{256}$ (T2) | $R_{256}$ (T1) | $R_{256}$ (T1) | $R_{256}$ ($\ell$-2) | $R_{256}$ ($\ell$-1) | |
| $R_{257}$ (T3) | $R_{257}$ (T3) | $R_{257}$ (T2) | $R_{257}$ (T2) | $R_{257}$ (T1) | $R_{257}$ (T1) | $R_{257}$ ($\ell$-2) | $R_{257}$ ($\ell$-1) | HDI2 |
| $R_{258}$ (T3) | $R_{258}$ (T3) | $R_{258}$ (T2) | $R_{258}$ (T2) | $R_{258}$ (T1) | $R_{258}$ (T1) | $R_{258}$ ($\ell$-2) | $R_{258}$ ($\ell$-1) | |
| ⋮ | ⋮ | ⋮ | ⋮ | ⋮ | ⋮ | ⋮ | ⋮ | |
| ⋮ | ⋮ | ⋮ | ⋮ | ⋮ | ⋮ | ⋮ | ⋮ | |
| $R_{511}$ (T3) | $R_{511}$ (T3) | $R_{511}$ (T2) | $R_{511}$ (T2) | $R_{511}$ (T1) | $R_{511}$ (T1) | $R_{511}$ ($\ell$-2) | $R_{511}$ ($\ell$-1) | |
| $R_{512}$ (T3) | $R_{512}$ (T3) | $R_{512}$ (T2) | $R_{512}$ (T2) | $R_{512}$ (T1) | $R_{512}$ (T1) | $R_{512}$ ($\ell$-2) | $R_{512}$ ($\ell$-1) | |
| $R_{513}$ (T3) | $R_{513}$ (T3) | $R_{513}$ (T2) | $R_{513}$ (T2) | $R_{513}$ (T1) | $R_{513}$ (T1) | $R_{513}$ ($\ell$-2) | $R_{513}$ ($\ell$-1) | HDI3 ~ HDI8 |
| $R_{514}$ (T3) | $R_{514}$ (T3) | $R_{514}$ (T2) | $R_{514}$ (T2) | $R_{514}$ (T1) | $R_{514}$ (T1) | $R_{514}$ ($\ell$-2) | $R_{514}$ ($\ell$-1) | |
| ⋮ | ⋮ | ⋮ | ⋮ | ⋮ | ⋮ | ⋮ | ⋮ | |
| ⋮ | ⋮ | ⋮ | ⋮ | ⋮ | ⋮ | ⋮ | ⋮ | |
| ⋮ | ⋮ | ⋮ | ⋮ | ⋮ | ⋮ | ⋮ | ⋮ | |

FIG. 4(b)

7B

| $PLD_0$ | |
|---|---|
| $R_1$ ($\ell$) | HDI1 |
| $R_2$ ($\ell$) | |
| $R_3$ ($\ell$) | |
| ⋮ | |
| ⋮ | |
| $R_{255}$ ($\ell$) | |
| $R_{256}$ ($\ell$) | |
| $R_{257}$ ($\ell$) | HDI2 |
| $R_{258}$ ($\ell$) | |
| ⋮ | |
| ⋮ | |
| $R_{511}$ ($\ell$) | |
| $R_{512}$ ($\ell$) | |
| $R_{513}$ ($\ell$) | HDI3 ~ HDI8 |
| $R_{514}$ ($\ell$) | |
| ⋮ | |
| ⋮ | |
| ⋮ | |

FIG. 5

| | | X | 1 | 2 | 3 | 4 | 5 | ----- | 255 | 256 | 257 | 258 | 259 | 260 | ----- | 511 | 512 | 513 | --- |
|---|---|---|---|---|---|---|---|---|---|---|---|---|---|---|---|---|---|---|---|
| ℓ-2 | A1 | $R_1$ (ℓ-2) | $R_2$ (ℓ-2) | $R_3$ (ℓ-2) | $R_4$ (ℓ-2) | $R_5$ (ℓ-2) | $R_6$ (ℓ-2) | ----- | $R_{256}$ (ℓ-2) | $R_{257}$ (ℓ-2) | $R_{258}$ (ℓ-2) | $R_{259}$ (ℓ-2) | $R_{260}$ (ℓ-2) | $R_{261}$ (ℓ-2) | ----- | $R_{512}$ (ℓ-2) | $R_{513}$ (ℓ-2) | $R_{514}$ (ℓ-2) | --- |
| | A3 | X | $R_1$ (ℓ-2) | $R_2$ (ℓ-2) | $R_3$ (ℓ-2) | $R_4$ (ℓ-2) | $R_5$ (ℓ-2) | ----- | $R_{255}$ (ℓ-2) | $R_{256}$ (ℓ-2) | $R_{257}$ (ℓ-2) | $R_{258}$ (ℓ-2) | $R_{259}$ (ℓ-2) | $R_{260}$ (ℓ-2) | ----- | $R_{511}$ (ℓ-2) | $R_{512}$ (ℓ-2) | $R_{513}$ (ℓ-2) | --- |
| | A2 | X | X | $R_1$ (ℓ-2) | $R_2$ (ℓ-2) | $R_3$ (ℓ-2) | $R_4$ (ℓ-2) | ----- | $R_{254}$ (ℓ-2) | $R_{255}$ (ℓ-2) | $R_{256}$ (ℓ-2) | $R_{257}$ (ℓ-2) | $R_{258}$ (ℓ-2) | $R_{259}$ (ℓ-2) | ----- | $R_{510}$ (ℓ-2) | $R_{511}$ (ℓ-2) | $R_{512}$ (ℓ-2) | --- |
| ℓ-1 | B1 | $R_1$ (ℓ-1) | $R_2$ (ℓ-1) | $R_3$ (ℓ-1) | $R_4$ (ℓ-1) | $R_5$ (ℓ-1) | $R_6$ (ℓ-1) | ----- | $R_{256}$ (ℓ-1) | $R_{257}$ (ℓ-1) | $R_{258}$ (ℓ-1) | $R_{259}$ (ℓ-1) | $R_{260}$ (ℓ-1) | $R_{261}$ (ℓ-1) | ----- | $R_{512}$ (ℓ-1) | $R_{513}$ (ℓ-1) | $R_{514}$ (ℓ-1) | --- |
| | B3 | X | $R_1$ (ℓ-1) | $R_2$ (ℓ-1) | $R_3$ (ℓ-1) | $R_4$ (ℓ-1) | $R_5$ (ℓ-1) | ----- | $R_{255}$ (ℓ-1) | $R_{256}$ (ℓ-1) | $R_{257}$ (ℓ-1) | $R_{258}$ (ℓ-1) | $R_{259}$ (ℓ-1) | $R_{260}$ (ℓ-1) | ----- | $R_{511}$ (ℓ-1) | $R_{512}$ (ℓ-1) | $R_{513}$ (ℓ-1) | --- |
| | B2 | X | X | $R_1$ (ℓ-1) | $R_2$ (ℓ-1) | $R_3$ (ℓ-1) | $R_4$ (ℓ-1) | ----- | $R_{254}$ (ℓ-1) | $R_{255}$ (ℓ-1) | $R_{256}$ (ℓ-1) | $R_{257}$ (ℓ-1) | $R_{258}$ (ℓ-1) | $R_{259}$ (ℓ-1) | ----- | $R_{510}$ (ℓ-1) | $R_{511}$ (ℓ-1) | $R_{512}$ (ℓ-1) | --- |
| ℓ | C1 | $R_1$ (ℓ) | $R_2$ (ℓ) | $R_3$ (ℓ) | $R_4$ (ℓ) | $R_5$ (ℓ) | $R_6$ (ℓ) | ----- | $R_{256}$ (ℓ) | $R_{257}$ (ℓ) | $R_{258}$ (ℓ) | $R_{259}$ (ℓ) | $R_{260}$ (ℓ) | $R_{261}$ (ℓ) | ----- | $R_{512}$ (ℓ) | $R_{513}$ (ℓ) | $R_{514}$ (ℓ) | --- |
| | C3 | X | $R_1$ (ℓ) | $R_2$ (ℓ) | $R_3$ (ℓ) | $R_4$ (ℓ) | $R_5$ (ℓ) | ----- | $R_{255}$ (ℓ) | $R_{256}$ (ℓ) | $R_{257}$ (ℓ) | $R_{258}$ (ℓ) | $R_{259}$ (ℓ) | $R_{260}$ (ℓ) | ----- | $R_{511}$ (ℓ) | $R_{512}$ (ℓ) | $R_{513}$ (ℓ) | --- |
| | C2 | X | X | $R_1$ (ℓ) | $R_2$ (ℓ) | $R_3$ (ℓ) | $R_4$ (ℓ) | ----- | $R_{254}$ (ℓ) | $R_{255}$ (ℓ) | $R_{256}$ (ℓ) | $R_{257}$ (ℓ) | $R_{258}$ (ℓ) | $R_{259}$ (ℓ) | ----- | $R_{510}$ (ℓ) | $R_{511}$ (ℓ) | $R_{512}$ (ℓ) | --- |

← DATA INPUT DIRECTION

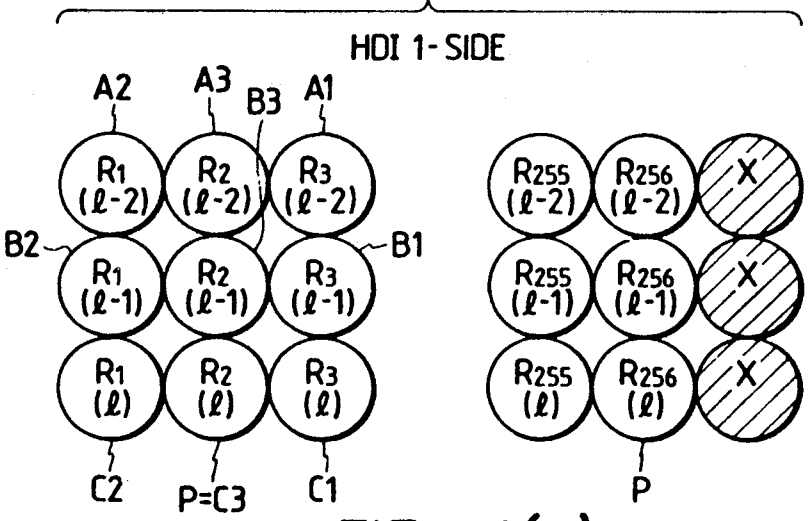
FIG. 6(a)
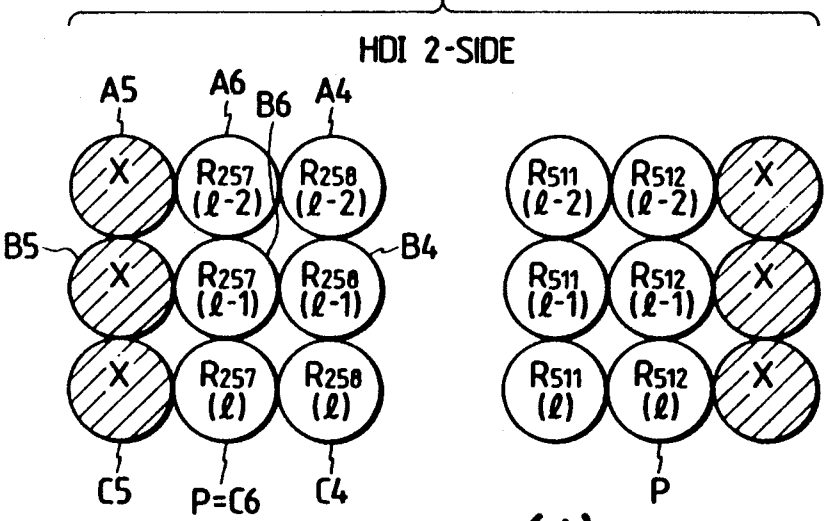
FIG. 6(b)
FIG. 6(c)
FIG. 6(d)

FIG. 10 (a)
PRIOR ART
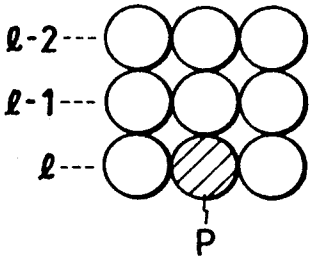
FIG. 10 (b)
PRIOR ART
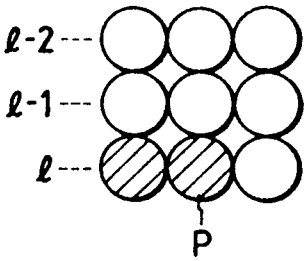
FIG. 10 (c)
PRIOR ART
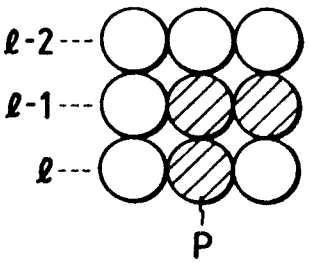
FIG. 10 (d)
PRIOR ART
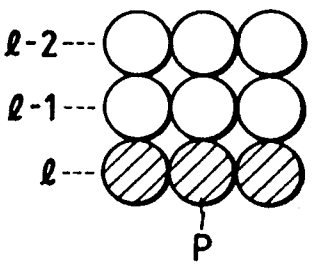
FIG. 10 (e)
PRIOR ART
FIG. 10 (f)
PRIOR ART
FIG. 10 (g)
PRIOR ART
FIG. 10 (h)
PRIOR ART

FIG. 14
PRIOR ART

| | $RD_0$ | $RD_1$ | $RD_2$ | $RD_3$ | $RD_4$ | $RD_5$ | $RD_6$ | $RD_7$ | |
|---|---|---|---|---|---|---|---|---|---|
| ADD 0 | $R_8$ (ℓ) | $R_7$ (ℓ) | $R_6$ (ℓ) | $R_5$ (ℓ) | $R_4$ (ℓ) | $R_3$ (ℓ) | $R_2$ (ℓ) | $R_1$ (ℓ) | HDI 1(ℓ) |
| 1 | $R_{16}$ (ℓ) | $R_{15}$ (ℓ) | $R_{14}$ (ℓ) | $R_{13}$ (ℓ) | $R_{12}$ (ℓ) | $R_{11}$ (ℓ) | $R_{10}$ (ℓ) | $R_9$ (ℓ) | |
| 2 | $R_{24}$ (ℓ) | $R_{23}$ (ℓ) | $R_{22}$ (ℓ) | $R_{21}$ (ℓ) | $R_{20}$ (ℓ) | $R_{19}$ (ℓ) | $R_{18}$ (ℓ) | $R_{17}$ (ℓ) | |
| 3 | $R_{32}$ (ℓ) | $R_{31}$ (ℓ) | $R_{30}$ (ℓ) | $R_{29}$ (ℓ) | $R_{28}$ (ℓ) | $R_{27}$ (ℓ) | $R_{26}$ (ℓ) | $R_{25}$ (ℓ) | |
| ⋮ | ⋮ | ⋮ | ⋮ | ⋮ | ⋮ | ⋮ | ⋮ | ⋮ | |
| | $R_{248}$ (ℓ) | $R_{247}$ (ℓ) | $R_{246}$ (ℓ) | $R_{245}$ (ℓ) | $R_{244}$ (ℓ) | $R_{243}$ (ℓ) | $R_{242}$ (ℓ) | $R_{241}$ (ℓ) | |
| | $R_{256}$ (ℓ) | $R_{255}$ (ℓ) | $R_{254}$ (ℓ) | $R_{253}$ (ℓ) | $R_{252}$ (ℓ) | $R_{251}$ (ℓ) | $R_{250}$ (ℓ) | $R_{249}$ (ℓ) | |
| | $R_{264}$ (ℓ) | $R_{263}$ (ℓ) | $R_{262}$ (ℓ) | $R_{261}$ (ℓ) | $R_{260}$ (ℓ) | $R_{259}$ (ℓ) | $R_{258}$ (ℓ) | $R_{257}$ (ℓ) | HDI 2(ℓ) |
| | $R_{272}$ (ℓ) | $R_{271}$ (ℓ) | $R_{270}$ (ℓ) | $R_{269}$ (ℓ) | $R_{268}$ (ℓ) | $R_{267}$ (ℓ) | $R_{266}$ (ℓ) | $R_{265}$ (ℓ) | |
| | $R_{280}$ (ℓ) | $R_{279}$ (ℓ) | $R_{278}$ (ℓ) | $R_{277}$ (ℓ) | $R_{276}$ (ℓ) | $R_{275}$ (ℓ) | $R_{274}$ (ℓ) | $R_{273}$ (ℓ) | |
| | $R_{288}$ (ℓ) | $R_{287}$ (ℓ) | $R_{286}$ (ℓ) | $R_{285}$ (ℓ) | $R_{284}$ (ℓ) | $R_{283}$ (ℓ) | $R_{282}$ (ℓ) | $R_{281}$ (ℓ) | |
| | ⋮ | ⋮ | ⋮ | ⋮ | ⋮ | ⋮ | ⋮ | ⋮ | |
| | $R_{504}$ (ℓ) | $R_{503}$ (ℓ) | $R_{502}$ (ℓ) | $R_{501}$ (ℓ) | $R_{500}$ (ℓ) | $R_{499}$ (ℓ) | $R_{498}$ (ℓ) | $R_{497}$ (ℓ) | |
| | $R_{512}$ (ℓ) | $R_{511}$ (ℓ) | $R_{510}$ (ℓ) | $R_{509}$ (ℓ) | $R_{508}$ (ℓ) | $R_{507}$ (ℓ) | $R_{506}$ (ℓ) | $R_{505}$ (ℓ) | |
| | $R_{520}$ (ℓ) | $R_{519}$ (ℓ) | $R_{518}$ (ℓ) | $R_{517}$ (ℓ) | $R_{516}$ (ℓ) | $R_{515}$ (ℓ) | $R_{514}$ (ℓ) | $R_{513}$ (ℓ) | HDI 3(ℓ) ~ 8(ℓ) |
| | ⋮ | ⋮ | ⋮ | ⋮ | ⋮ | ⋮ | ⋮ | ⋮ | |

ℓ : PRINTING LINE

FIG. 16
PRIOR ART

| | X | 1 | 2 | 3 | 4 | 5 | 6 | 7 | 8 | | 255 | 256 |
|---|---|---|---|---|---|---|---|---|---|---|---|---|
| A1 | $R_1$ ($\ell$-2) | $R_2$ ($\ell$-2) | $R_3$ ($\ell$-2) | $R_4$ ($\ell$-2) | $R_5$ ($\ell$-2) | $R_6$ ($\ell$-2) | $R_7$ ($\ell$-2) | $R_8$ ($\ell$-2) | $R_9$ ($\ell$-2) | ----- | $R_{256}$ ($\ell$-2) | X |
| A3 | X | $R_1$ ($\ell$-2) | $R_2$ ($\ell$-2) | $R_3$ ($\ell$-2) | $R_4$ ($\ell$-2) | $R_5$ ($\ell$-2) | $R_6$ ($\ell$-2) | $R_7$ ($\ell$-2) | $R_8$ ($\ell$-2) | ----- | $R_{255}$ ($\ell$-2) | $R_{256}$ ($\ell$-2) |
| A2 | X | X | $R_1$ ($\ell$-2) | $R_2$ ($\ell$-2) | $R_3$ ($\ell$-2) | $R_4$ ($\ell$-2) | $R_5$ ($\ell$-2) | $R_6$ ($\ell$-2) | $R_7$ ($\ell$-2) | ----- | $R_{254}$ ($\ell$-2) | $R_{255}$ ($\ell$-2) |
| B1 | $R_1$ ($\ell$-1) | $R_2$ ($\ell$-1) | $R_3$ ($\ell$-1) | $R_4$ ($\ell$-1) | $R_5$ ($\ell$-1) | $R_6$ ($\ell$-1) | $R_7$ ($\ell$-1) | $R_8$ ($\ell$-1) | $R_9$ ($\ell$-1) | ----- | $R_{256}$ ($\ell$-1) | X |
| B3 | X | $R_1$ ($\ell$-1) | $R_2$ ($\ell$-1) | $R_3$ ($\ell$-1) | $R_4$ ($\ell$-1) | $R_5$ ($\ell$-1) | $R_6$ ($\ell$-1) | $R_7$ ($\ell$-1) | $R_8$ ($\ell$-1) | ----- | $R_{255}$ ($\ell$-1) | $R_{256}$ ($\ell$-1) |
| B2 | X | X | $R_1$ ($\ell$-1) | $R_2$ ($\ell$-1) | $R_3$ ($\ell$-1) | $R_4$ ($\ell$-1) | $R_5$ ($\ell$-1) | $R_6$ ($\ell$-1) | $R_7$ ($\ell$-1) | ----- | $R_{254}$ ($\ell$-1) | $R_{255}$ ($\ell$-1) |
| C1 | $R_1$ ($\ell$) | $R_2$ ($\ell$) | $R_3$ ($\ell$) | $R_4$ ($\ell$) | $R_5$ ($\ell$) | $R_6$ ($\ell$) | $R_7$ ($\ell$) | $R_8$ ($\ell$) | $R_9$ ($\ell$) | ----- | $R_{256}$ ($\ell$) | X |
| C3 | X | $R_1$ ($\ell$) | $R_2$ ($\ell$) | $R_3$ ($\ell$) | $R_4$ ($\ell$) | $R_5$ ($\ell$) | $R_6$ ($\ell$) | $R_7$ ($\ell$) | $R_8$ ($\ell$) | ----- | $R_{255}$ ($\ell$) | $R_{256}$ ($\ell$) |
| C2 | X | X | $R_1$ ($\ell$) | $R_2$ ($\ell$) | $R_3$ ($\ell$) | $R_4$ ($\ell$) | $R_5$ ($\ell$) | $R_6$ ($\ell$) | $R_7$ ($\ell$) | ----- | $R_{254}$ ($\ell$) | $R_{255}$ ($\ell$) |

| | X | 257 | 258 | 259 | 260 | 261 | 262 | 263 | 264 | | 511 | 512 |
|---|---|---|---|---|---|---|---|---|---|---|---|---|
| A4 | $R_{257}$ ($\ell$-2) | $R_{258}$ ($\ell$-2) | $R_{259}$ ($\ell$-2) | $R_{260}$ ($\ell$-2) | $R_{261}$ ($\ell$-2) | $R_{262}$ ($\ell$-2) | $R_{263}$ ($\ell$-2) | $R_{264}$ ($\ell$-2) | $R_{265}$ ($\ell$-2) | ----- | $R_{512}$ ($\ell$-2) | X |
| A6 | X | $R_{257}$ ($\ell$-2) | $R_{258}$ ($\ell$-2) | $R_{259}$ ($\ell$-2) | $R_{260}$ ($\ell$-2) | $R_{261}$ ($\ell$-2) | $R_{262}$ ($\ell$-2) | $R_{263}$ ($\ell$-2) | $R_{264}$ ($\ell$-2) | ----- | $R_{511}$ ($\ell$-2) | $R_{512}$ ($\ell$-2) |
| A5 | X | X | $R_{257}$ ($\ell$-2) | $R_{258}$ ($\ell$-2) | $R_{259}$ ($\ell$-2) | $R_{260}$ ($\ell$-2) | $R_{261}$ ($\ell$-2) | $R_{262}$ ($\ell$-2) | $R_{263}$ ($\ell$-2) | ----- | $R_{510}$ ($\ell$-2) | $R_{511}$ ($\ell$-2) |
| B4 | $R_{257}$ ($\ell$-1) | $R_{258}$ ($\ell$-1) | $R_{259}$ ($\ell$-1) | $R_{260}$ ($\ell$-1) | $R_{261}$ ($\ell$-1) | $R_{262}$ ($\ell$-1) | $R_{263}$ ($\ell$-1) | $R_{264}$ ($\ell$-1) | $R_{265}$ ($\ell$-1) | ----- | $R_{512}$ ($\ell$-1) | X |
| B6 | X | $R_{257}$ ($\ell$-1) | $R_{258}$ ($\ell$-1) | $R_{259}$ ($\ell$-1) | $R_{260}$ ($\ell$-1) | $R_{261}$ ($\ell$-1) | $R_{262}$ ($\ell$-1) | $R_{263}$ ($\ell$-1) | $R_{264}$ ($\ell$-1) | ----- | $R_{511}$ ($\ell$-1) | $R_{512}$ ($\ell$-1) |
| B5 | X | X | $R_{257}$ ($\ell$-1) | $R_{258}$ ($\ell$-1) | $R_{259}$ ($\ell$-1) | $R_{260}$ ($\ell$-1) | $R_{261}$ ($\ell$-1) | $R_{262}$ ($\ell$-1) | $R_{263}$ ($\ell$-1) | ----- | $R_{510}$ ($\ell$-1) | $R_{511}$ ($\ell$-1) |
| C4 | $R_{257}$ ($\ell$) | $R_{258}$ ($\ell$) | $R_{259}$ ($\ell$) | $R_{260}$ ($\ell$) | $R_{261}$ ($\ell$) | $R_{262}$ ($\ell$) | $R_{263}$ ($\ell$) | $R_{264}$ ($\ell$) | $R_{265}$ ($\ell$) | ----- | $R_{512}$ ($\ell$) | X |
| C6 | X | $R_{257}$ ($\ell$) | $R_{258}$ ($\ell$) | $R_{259}$ ($\ell$) | $R_{260}$ ($\ell$) | $R_{261}$ ($\ell$) | $R_{262}$ ($\ell$) | $R_{263}$ ($\ell$) | $R_{264}$ ($\ell$) | ----- | $R_{511}$ ($\ell$) | $R_{512}$ ($\ell$) |
| C5 | X | X | $R_{257}$ ($\ell$) | $R_{258}$ ($\ell$) | $R_{259}$ ($\ell$) | $R_{260}$ ($\ell$) | $R_{261}$ ($\ell$) | $R_{262}$ ($\ell$) | $R_{263}$ ($\ell$) | ----- | $R_{510}$ ($\ell$) | $R_{511}$ ($\ell$) |

← DATA INPUT DIRECTION

THERMAL PRINTER CONTROL APPARATUS EMPLOYING THERMAL CORRECTION DATA

BACKGROUND OF THE INVENTION

This invention relates to line printers, and more particularly to the control of electrical energization of the thermal head of a printer.

The arrangement of a conventional printer of this type will be described with reference to FIGS. 7 and 8.

FIG. 7 is a block diagram showing the arrangement of the conventional printer, and FIG. 8 is a circuit diagram showing the thermal head of the conventional printer.

The conventional printer, as shown in FIG. 7, comprises: a CPU 1; a ROM 2 connected to the CPU 1 through a bus; a RAM 3 connected to the bus; a parallel data input interface 4; a counter connected to the bus and the parallel data input interface 4; an input/output port 6 connected to the bus and the parallel data input interface 4; a line buffer 7 connected to the parallel data input interface 4; a P/S (parallel to serial conversion) circuit 8 connected to the line buffer 7; a latch circuit 9 connected to the P/S circuit 8; a latch circuit 10 connected to the latch circuit 9; a P/S circuit 11 connected to the line buffer 7; a latch circuit 12 connected to the P/S circuit 11; a latch circuit 13 connected to the latch circuit 12; a P/S circuit 14 connected to the line buffer 7; a latch circuit 15 connected to the P/S circuit 14; a latch circuit 16 connected to the latch circuit 15; a ROM 17 connected to those P/S circuits 8, 11 and 14 and latch circuits 9, 10, 12, 13, and 16; a switch circuit 18 connected to the ROM 17; an AND circuit 19 connected to the switch circuit 18 and the latch circuit 15; a thermal head 20 connected to the AND circuit 19; and a head temperature detecting circuit 21 whose input and output are connected to the thermal head 20 and the input/output port 6, respectively.

The thermal head 20, as shown in FIG. 8, comprises: 2048 heat generating resistance elements R1 through R2048; 32 shift registers LSINO.0 through LSINO.31; power terminals: a CLOCK terminal; and an HLTH terminal.

Now, the operation of the conventional printer thus constructed will be described.

Printing data are applied through the parallel data input interface 4 to the line buffer 7. The data of an aimed dot in a line to be printed is applied, as an output C3 of the latch circuit 15, to the AND circuit 19. The data of the dot before the aimed dot is applied as an output C2 to the ROM 17, and the data of the dot after the aimed dot is applied as an output C1 to the ROM 17.

The data of an aimed dot in the line before the line to be printed is applied, as an output B3, to the ROM 17. The data of the dot before the aimed dot is applied, as an output B2, to the ROM 17, and the data of the dot after the aimed dot is applied, as an output B1, to the ROM 17.

The data of an aimed dot in the line which is located two lines before the line to be printed is applied, as an output A3, to the ROM 17. The data of the dot before the aimed dot is applied, as an output A2, to the ROM 17, and the data of the dot after the aimed dot is applied, as an output A1, to the ROM 17.

The electrical energization time control of the thermal head 20 will be described with reference to FIG. 9.

FIG. 9 is a flow chart for a description of the electrical energization time control of the conventional printer.

In Step S10, the CPU 1 detects the temperature of the thermal head 20 with the aid of the head temperature detecting circuit 21. The temperature detection data is stored in the RAM 3.

In Step S11, the printing interval of each line; that is, a recording period is obtained, and stored in the RAM 3.

In Step S12, the real record dot number of a line to be printed is obtained.

In Step S13, a degree of thermal effect on the printing line is obtained according to the above-described recording period and real recording dot number;

In Step S14, the above-described degree of thermal effect is obtained for each of the first to current (present) lines, and the degrees of thermal effect thus obtained are stored.

In Step S15, a correcting value is obtained according to the degrees of thermal effect thus stored and the head temperature.

In Step S16, an electrical energization time is obtained according to the head temperature and the recording period, and the above-described correcting value is used to obtain a fundamental energization time T1. In addition, adjusting energization times T2, T3 and T4 are obtained according to the outputs A1, A2, A3, B1, B2, B3, C1 and C2 of the latch circuits, when necessary.

In Step S17, the thermal head 20 is energized according to the fundamental energization time T1 and the adjusting energization times T2, T3 and T4.

In Step S18, the above-described operations of Steps S11 through S17 are carried out repeatedly until the printing operation is accomplished.

The electrical energization time control will be described with reference to FIGS. 10 and 11 in more detail.

FIG. 10 is an explanatory diagram showing the data patterns of dots surrounding an aimed dot, and FIG. 11 is a timing chart indicating printing timing with the data patterns shown in FIG. 10.

The parts (a) through (h) of FIG. 10 shows eight typical states of dots surrounding an aimed dot P in a line l to be printed. In FIG. 10, reference characters l-1 designates the line before the line l to be printed; and l-2 designates the line located two lines before the line l. Furthermore, in FIG. 10, hatched dots are to be printed black.

In the case of the part (a) of FIG. 10, the dots on both sides of the aimed dot P, and the dots on the lines l-1 and l-2 are not printed. In this case, the heat generating resistance element for the aimed dot P is not affected by the heat of the other dots at all, and therefore the energization time is the sum of the fundamental energization time T1 and the adjusting energization times T2, T3 and T4 as shown in the part (j) of FIG. 11.

In the case of the part (b) of FIG. 10, the dot on the left side of the aimed dot P is printed. In this case, the heat generating resistance element for the dot affects the one for the aimed dot P, and therefore in the total energization time, the adjusting energization time T2 is off as shown in the part (i) of FIG. 11.

In the case of the part (c) of FIG. 10, the heat generating resistance element for the aimed dot P has printed black dots on the preceding line l-1. In this case, in the total energization time, the adjusting energization time T3 is off as shown in the part (h) of FIG. 11.

As can be estimated from the above description, in the cases of the parts (d), (e), (f), (g) and (h) of FIG. 10, the energization times are indicated in the parts (g), (f), (e), (d) and (c) of FIG. 11, respectively. The parts (a) and (b) of FIG. 11 show printing data, and latch signals, respectively.

In the above-described case, reference is made to dots other than end dots of every data input of the thermal head 20 with eight reference dots of an aimed dot taken into account.

Now, a reference method in which reference is made to end dots of each data input of the thermal head will be described with reference to FIGS. 12 through 16.

FIG. 12 is an explanatory diagram showing separation of the heat generating resistance elements of the thermal head 20 shown in FIG. 8. FIG. 13 and FIG. 14 are explanatory diagrams showing the arrangement of memory in the line buffer 7. FIG. 15 is a block diagram showing a conventional reference circuit. FIG. 16 is an explanatory diagram showing reference timing in the prior art.

The 2048 heat generating resistance elements R1 through R2048 are connected to the serial in 64-bit shift registers LSINO0 through LSINO31, and each of the data inputs HDI1 through HDI8 is handled by four shift registers; that is, each data input has 256 bits.

For the purpose of high speed printing, two data inputs form an electrical energization block; that is, 512 bits can be energized at the same time.

Thus, as shown in FIG. 8, the 2048 heat generating resistance elements are divided into four energization blocks HSB1, HSB2, HSB3 and HSB4.

The thermal head 20 is designed as shown in FIGS. 8 and 12. Therefore, the arrangement of memory of the line buffer 7 is allocated to data inputs of the thermal head 20, and in the data inputs, the data corresponding to the heat generating resistance elements R1 through R2048 are allocated as shown in FIG. 14, being transferred, 8 bits by 8 bits, from the parallel data input interface 4.

As shown in FIG. 15, the conventional reference circuit has two blocks equation in arrangement so that two data inputs can be transferred simultaneously. One of the two blocks is for the data inputs HDI1, HDI3, HDI5 and HDI7 of the thermal head 20, and the other is for the data inputs HDI2, HDI4, HDI6 and HDI8.

The conventional reference method for an end dot of each data input is such that, for instance in the case where the aimed dot is R256(l) in FIG. 16, reference is made to only five of the eight reference dots. Similarly, in the conventional reference method, for an end dot of each data input such as the aimed dot R257(l) or R512(l) reference is made to five dots, for energization control.

As was described above, in the conventional printer, for an end dot of each data input, reference is made to only five of the eight reference dots to perform energization control. Therefore, the resultant print includes a printing defect such as a vertical stripe for every end dot.

SUMMARY OF THE INVENTION

Accordingly, an object of the invention is to eliminate the above-described difficulty accompanying a conventional printer. More specifically, an object of the invention is to provide a printer which is improved in print quality.

A printer according to the invention comprises the following means:

(i) first storage means for storing at least data on dots adjacent to an aimed dot on a line to be printed;

(ii) second storage means for storing data on aimed dots on the line immediately before the line to be printed and on the line located two line before the line to be printed, and at least data on dots adjacent to the aimed dots on the line immediately before the line to be printed and the line located two lines before the line to be printed;

(iii) third storage means for storing correcting data formed according to the data stored by the first and second storage means; and (iv) control means for controlling the energization time of the aimed dot on the line to be printed, according to the correcting data.

In the printer of the invention, the first storage means stores at least data on dots adjacent to an aimed dot on a line to be printed, the second storage means stores the data on aimed dots on the line immediately before the line to be printed and on the line located two line before the line to be printed, and at least data on dots adjacent to the aimed dots on the line immediately before the line to be printed and the line located two lines before the line to be printed, the third storage means stores correcting data formed according to the data stored by the first and second storage means, and the control means controls the energization time of the aimed dot on the line to be printed, according to the correcting data.

BRIEF DESCRIPTION OF THE DRAWINGS

FIGS. 3A, 3B and 4A, 4B are explanatory diagrams showing the arrangements of line buffers in the embodiment. FIG. 5 is an explanatory diagram showing reference timing in the embodiment. FIGS. 6(*a*)-(*d*) are an explanatory diagram showing a reference method in the embodiment and a conventional reference method. FIGS. 10(*a*)-10(*h*) are an explanatory diagram showing the data patterns of dots surrounding an aimed dot in the conventional printer. FIGS. 13 and 14 are explanatory diagrams showing the arrangement of memory of the line buffer in the conventional printer. FIG. 16 is an explanatory diagram indicating reference timing in the conventional printer.

PREFERRED EMBODIMENT OF THE INVENTION

The arrangement of one embodiment of this invention will be described with reference to FIGS. 1 and 2.

Figure 1:
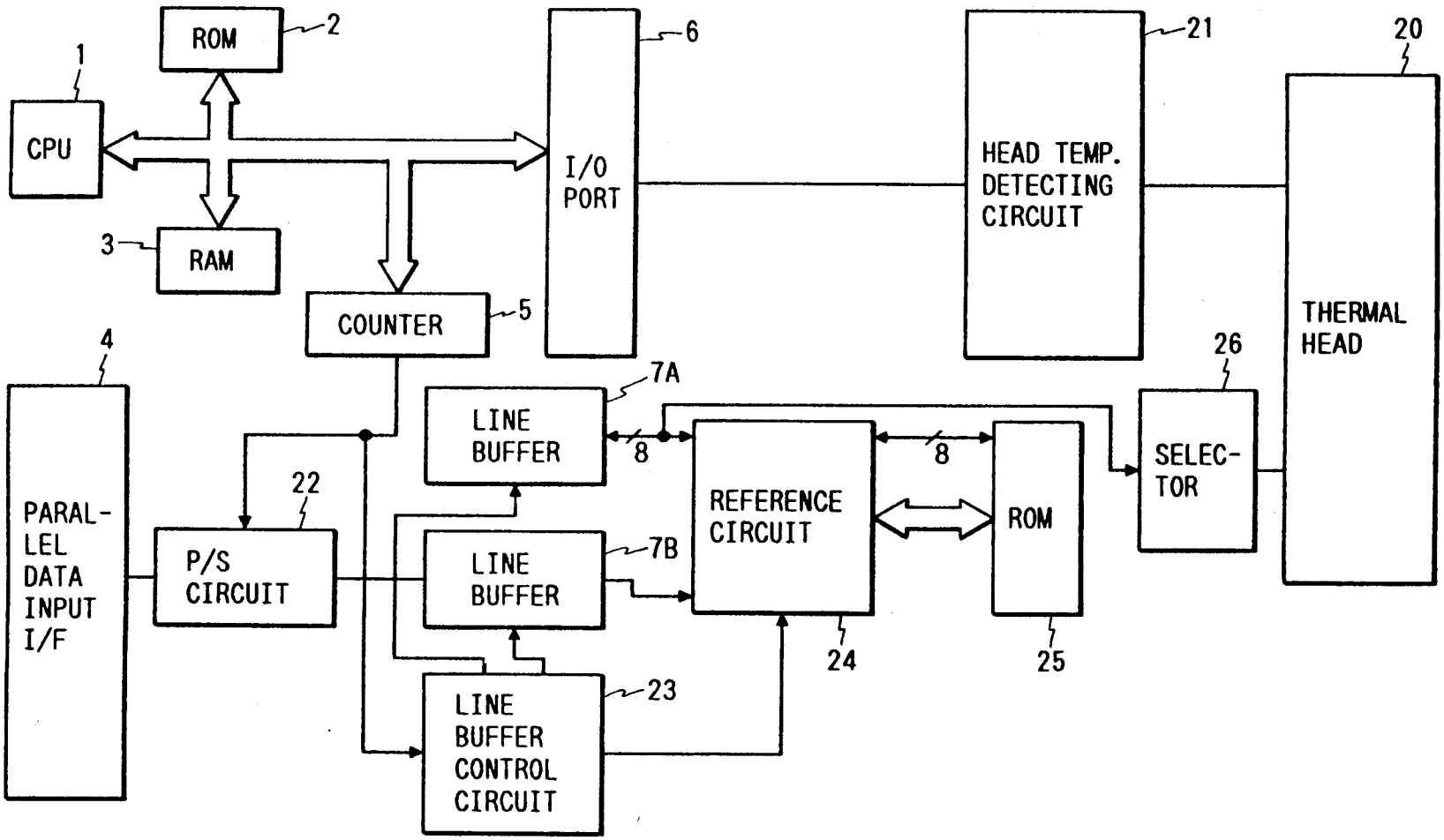
FIG. 1 is a block diagram showing the arrangement of one embodiment of this invention.

FIG. 1 is a block diagram showing the arrangement of the embodiment of the invention. In FIG. 1, reference numerals 1 through 6, 20 and 21 designate the same components as those in FIG. 7 (the conventional printer).

Figure 7:
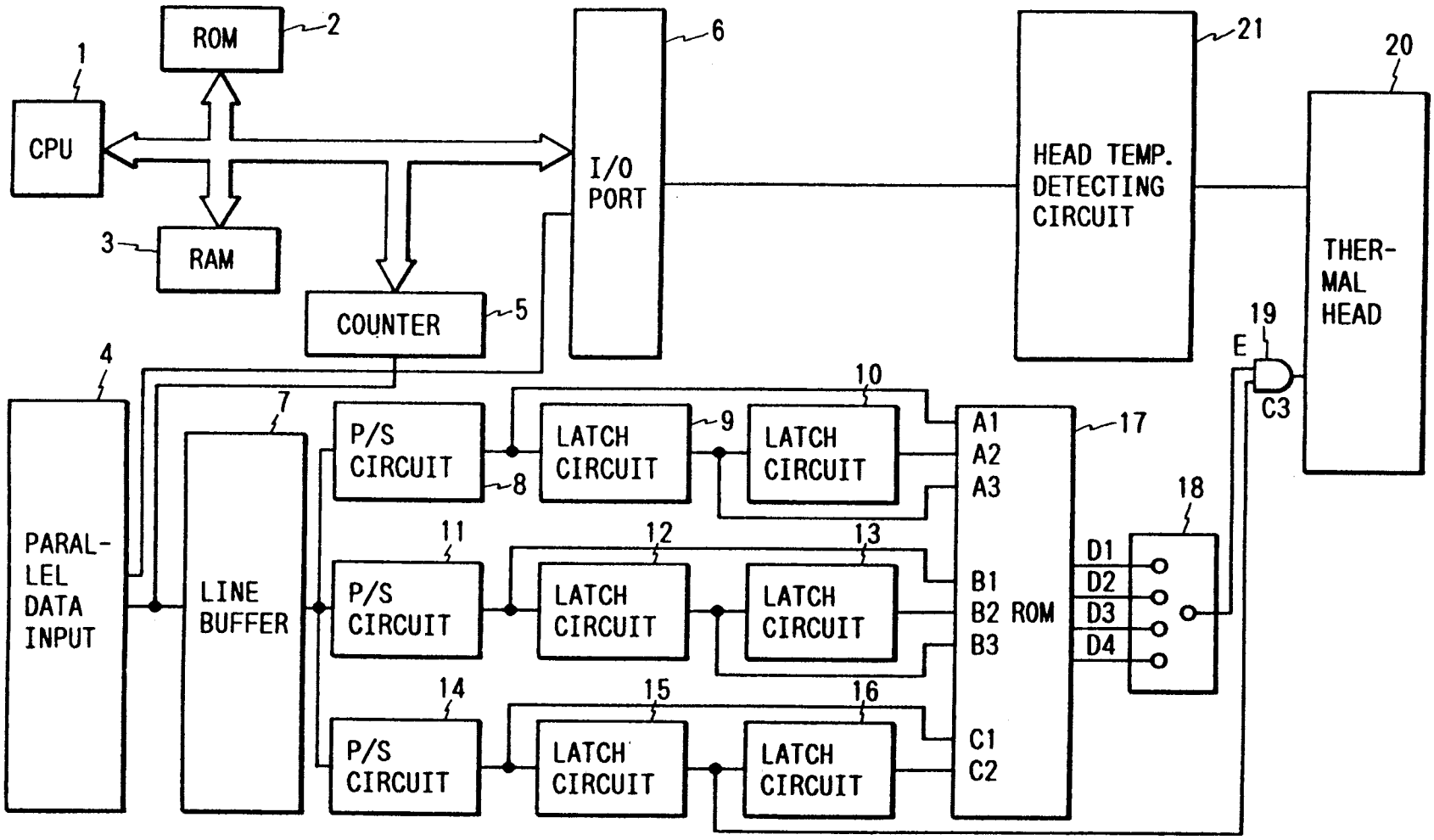
FIG. 7 PRIOR ART
FIG. 7 is a block diagram showing the arrangement of a conventional printer.
Figure 8:
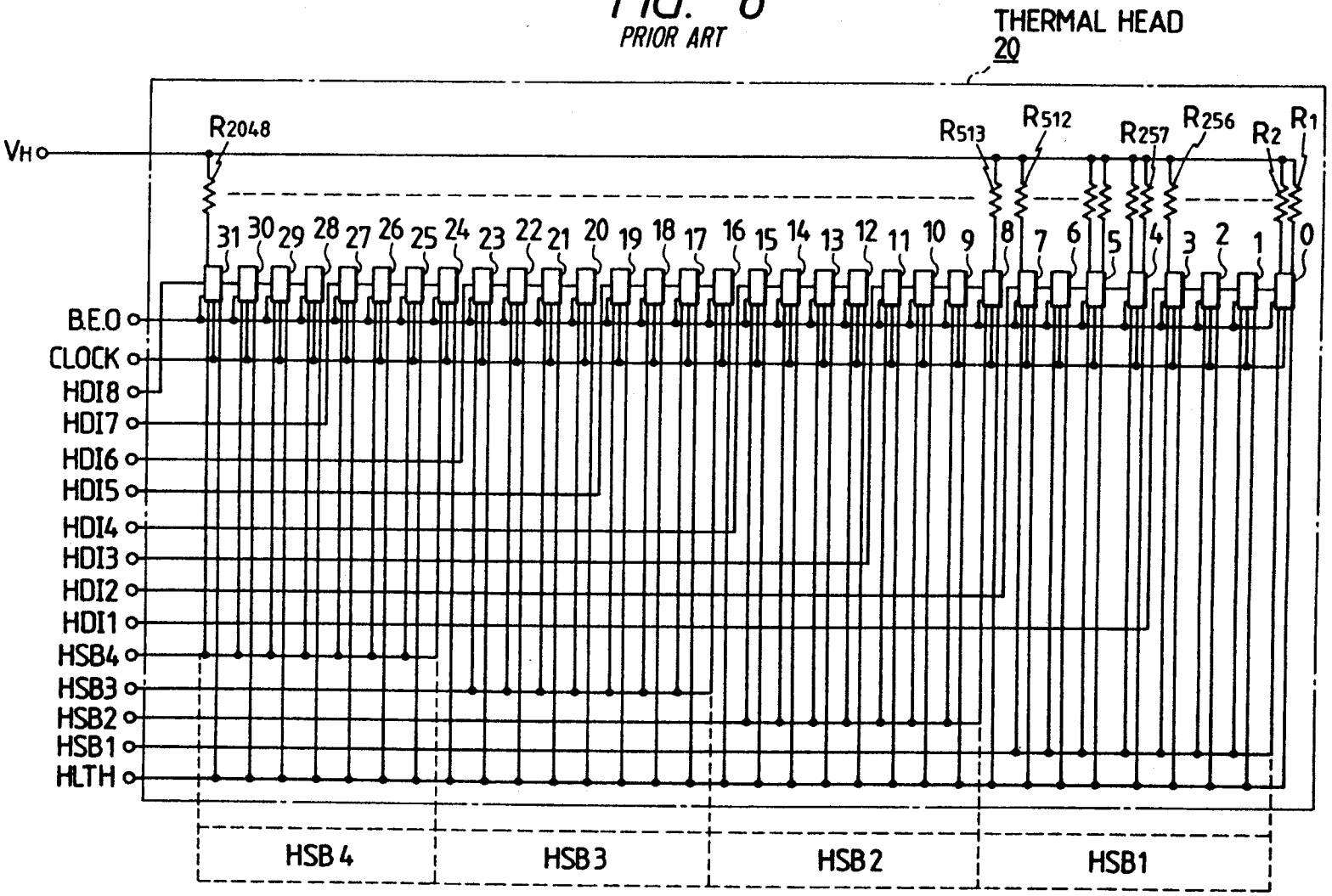
FIG. 8 PRIOR ART
FIG. 8 is a circuit diagram of a conventional thermal head.

The embodiment, as shown in FIG. 1, comprises: the above- described CPU 1, ROM 2, RAM 3, parallel data input interface 4, counter 5, input/output port 6, thermal head 20 and head temperature detecting circuit 21 which are the same as those in FIG. 7; a P/S (parallel to serial conversion) circuit 22 connected to the parallel data input interface 4 and the counter 5; a line buffer control circuit 23 connected to the counter 5; a line buffer 7A connected to the line buffer control circuit 23; a line buffer 7B connected to the P/S circuit 22 and the line buffer control circuit 23; a reference circuit 24 connected to the line buffers 7A and 7B and the line buffer control circuit 23; a ROM 25 connected to the reference circuit 24; and a selector 26 connected to the reference circuit 24. The selector 26 is connected to the thermal head 20.

Figure 2:
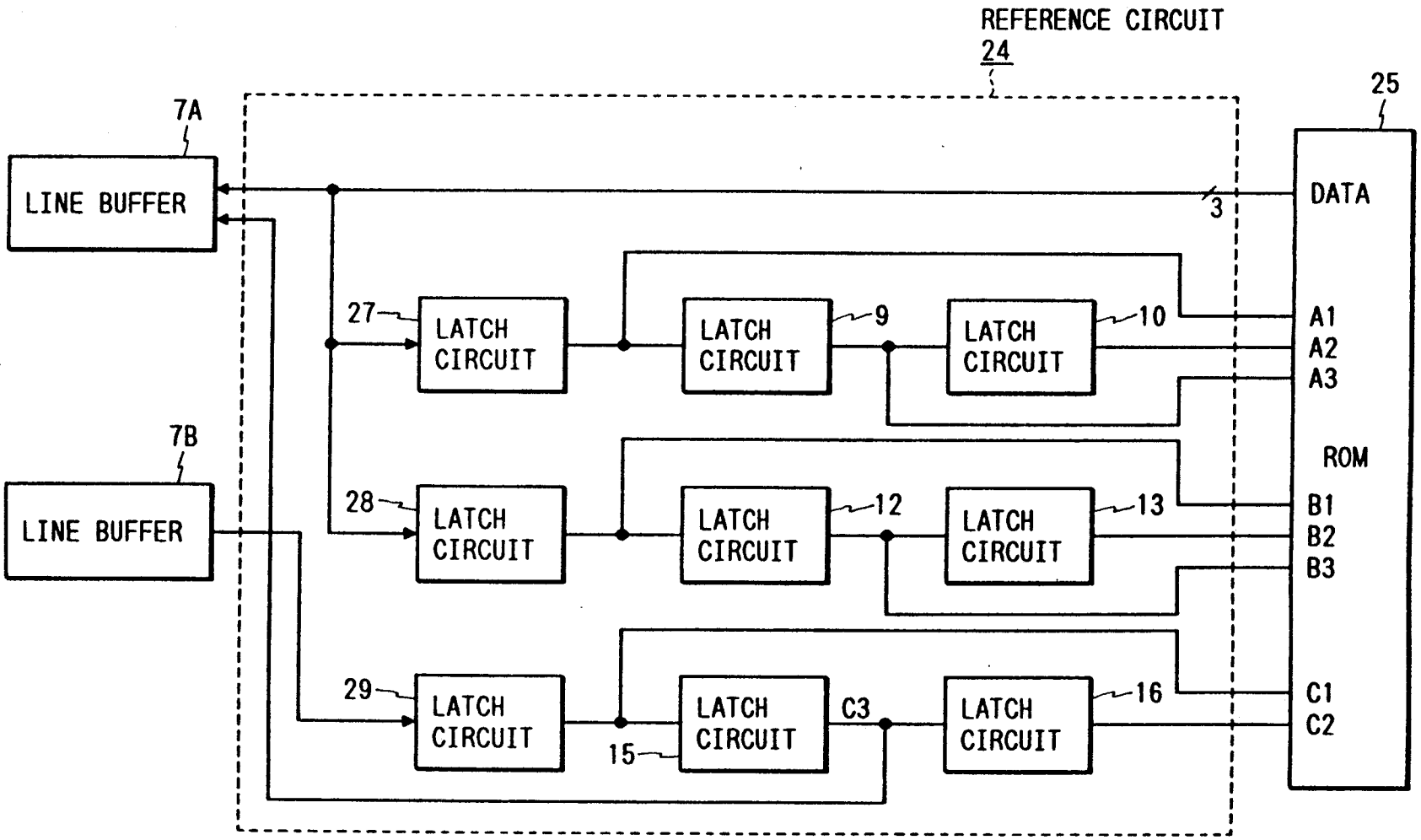
FIG. 2 is a block diagram showing a reference circuit in the embodiment.

FIG. 2 is a block diagram showing the reference circuit 24 in the embodiment of the invention.

The reference circuit 24 comprises: a latch circuit 27 connected to the line buffer 7A; a latch circuit 9 connected to the latch circuit 27; a latch circuit 10 connected to the latch circuit 9; a latch circuit 28 connected to the line buffer 7A; a latch circuit 12 connected to the latch circuit 28; a latch circuit 13 connected to the latch circuit 12; a latch circuit 29 connected to the line buffer 7B; a latch circuit 15 connected to the latch circuit 29; and a latch circuit 16 connected to the latch circuit 15. Those latch circuits 27, 9, 10, 28, 12, 13, 29 and 16 are connected to the above-described ROM 25. The line buffer 7A is connected to the latch circuit 15.

In the above-described embodiment of the invention, first storage means comprises the latch circuits 29, 15 and 16, second storage means comprises the latch circuits 27, 9, 10, 28, 12 and 13, third storage means is the line buffer 7A, and control means is the ROM 25.

The operation of the above-described embodiment will be described with reference also to FIGS. 3, 4, 5 and 6.

Printing data are applied through the parallel data input interface 4 to the P/S circuit 22, where they are converted into serial data, which are applied to the line buffer 7B (serial in serial out).

The data of an aimed dot on a line l to be printed is applied, as the output C3 of the latch circuit 15, to the line buffer 7A. The data of the adjacent dot before the aimed dot is applied, as an output C2, to the ROM 25, and the data of the adjacent dot after the aimed dot is applied, as an output C1, to the ROM 25.

The data of an aimed dot on the line before the line l to be printed is applied, as an output B3, to the ROM 25. The data of the adjacent dot before the aimed dot is applied, as an output B2, to the ROM 25, and the data of the adjacent dot after the aimed dot is applied, as an output B1, to the ROM 25.

The data of the aimed dot on the line located two lines before the line to be printed is applied, as an output A3, to the ROM 25. The data of the adjacent dot before the aimed dot is applied, as an output A2, to the ROM 25, and the data of the adjacent dot after the aimed dot is applied, as an output A1, to the ROM 25.

As shown in FIG. 3, in each of the line buffers 7A and 7B, the arrangement of memory is allocated to the data inputs HDI1 through HDI8 of the thermal head 20.

The data R1(l) through R2048(l) of the line l to be printed, corresponding to the heat generating resistance elements R1 through R2048 of each data input, the data R1(l-1) through R2048(l-1) of the line l-1 before the line l, the data R1(l-2) through R2048(l-2) of the line l-2 located two lines before the line l, and the data of energization times T1, T2 and T3 (each of those data being provided twice for convenience in arithmetic operation) are allocated as shown in FIG. 4, because the correcting data of the P/S circuit 22, the reference circuit 24 (the output C3 of the latch circuit 15) and the ROM 25 are provided in serial manner.

Figure 9:
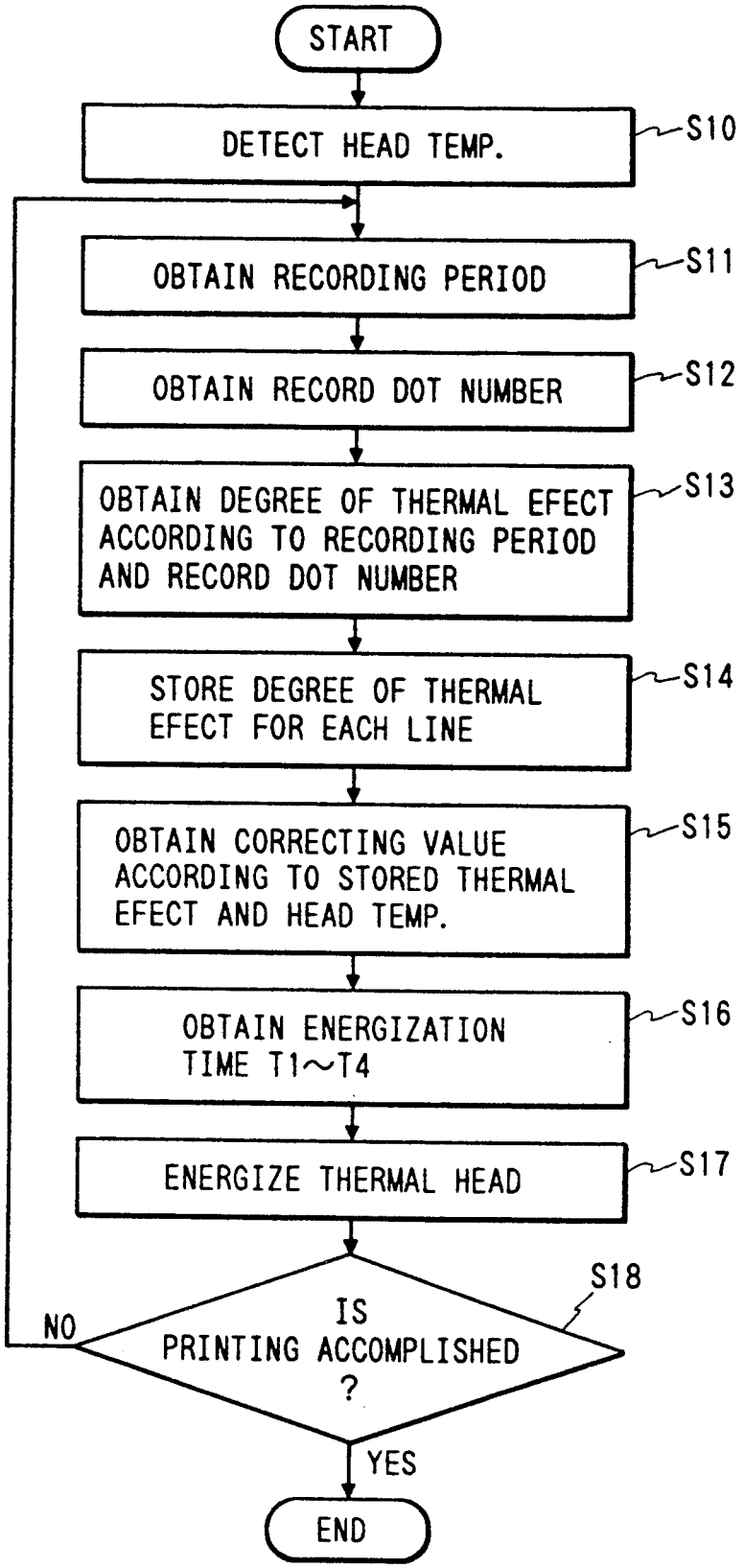
FIG. 9 PRIOR ART
FIG. 9 is a flow chart for a description of the operation of the conventional printer.
Figure 11:
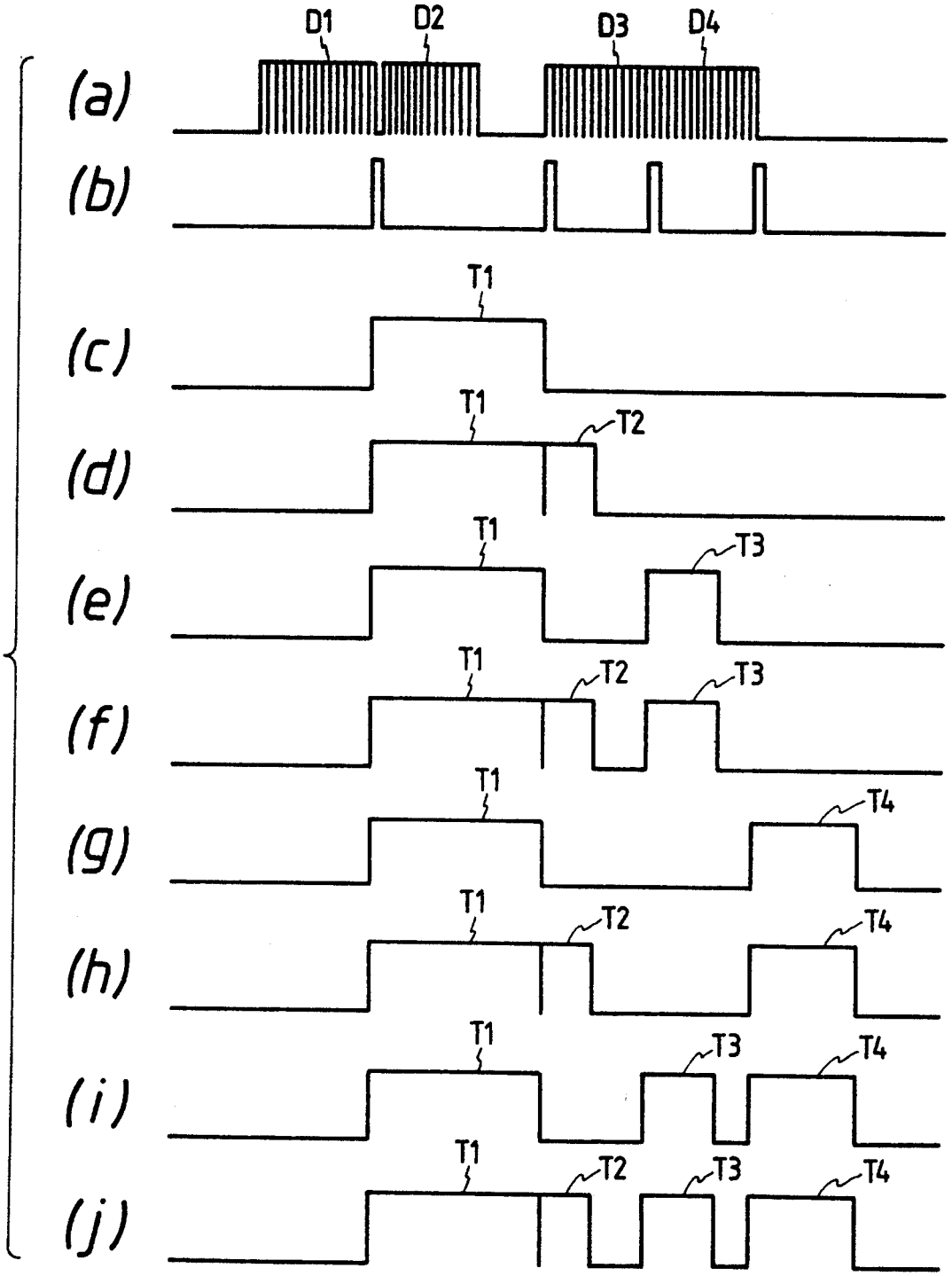
FIG. 11 PRIOR ART
FIGS. 11(*a*)-(*j*) are a timing chart indicating printing timing with respect to the data patterns shown in FIG. 10.
Figure 12:
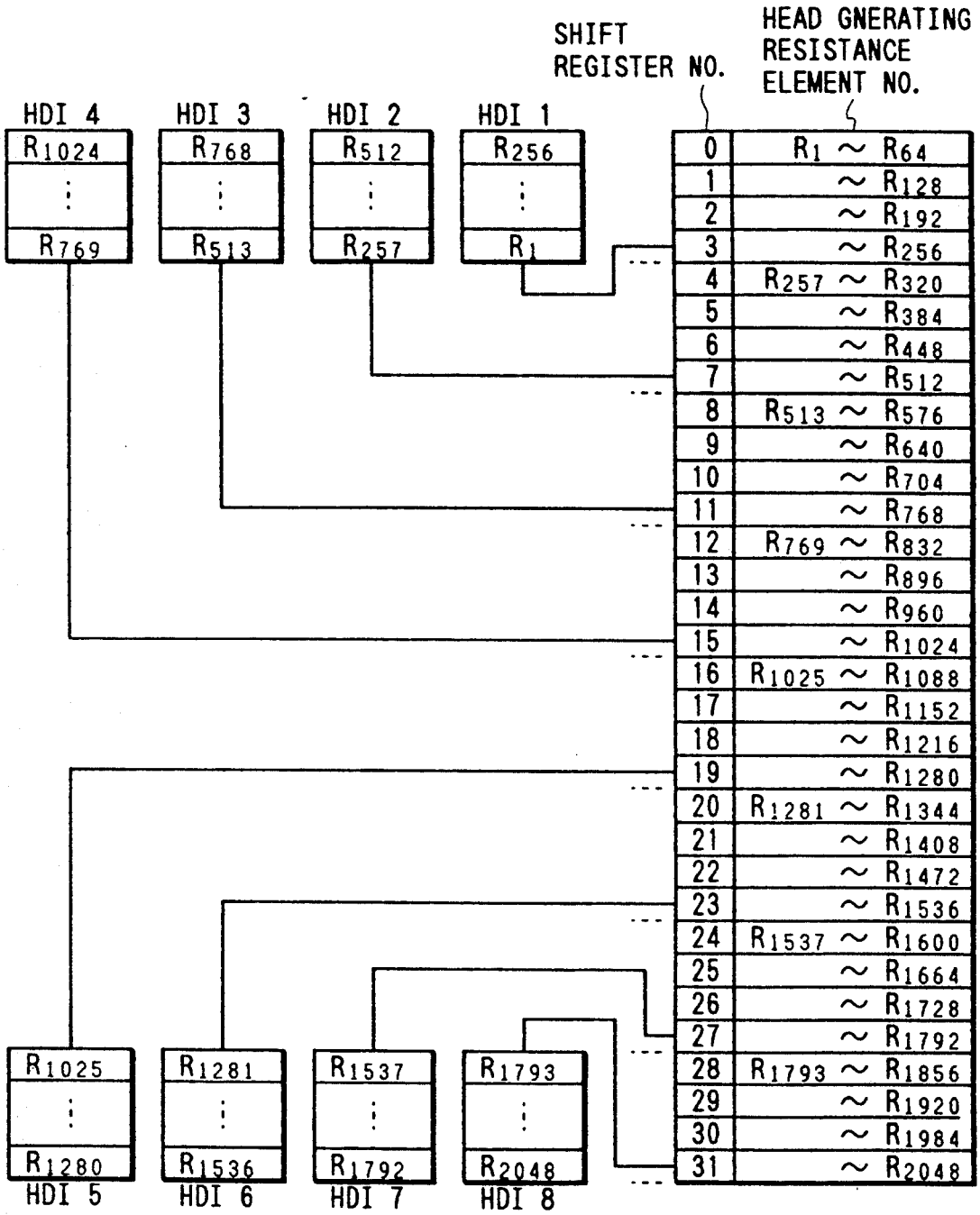
FIG. 12 PRIOR ART
FIG. 12 is an explanatory diagram showing the internal arrangement of the thermal head in the conventional printer.
Figure 13:
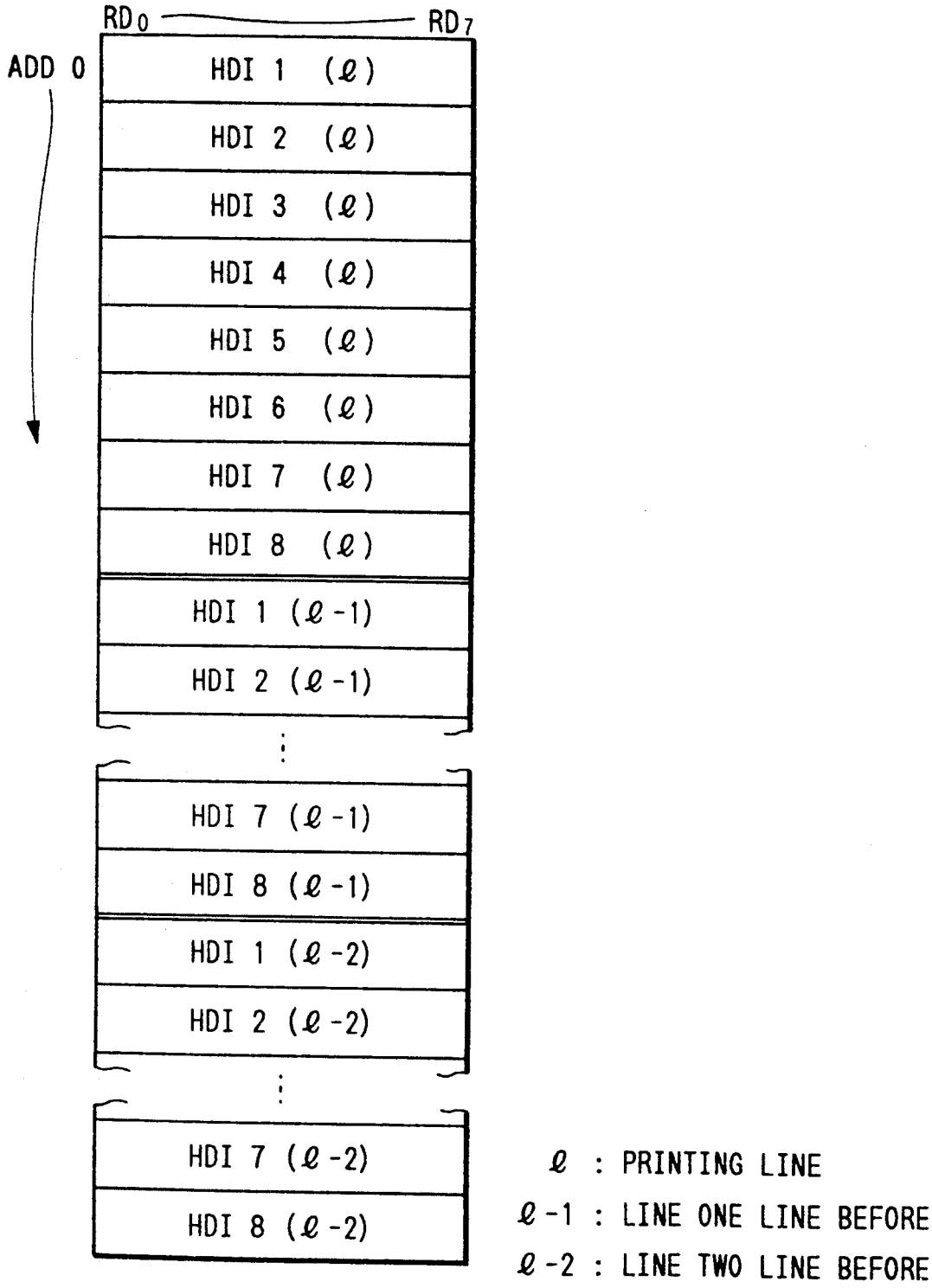
FIG. 13 PRIOR ART
Figure 15:
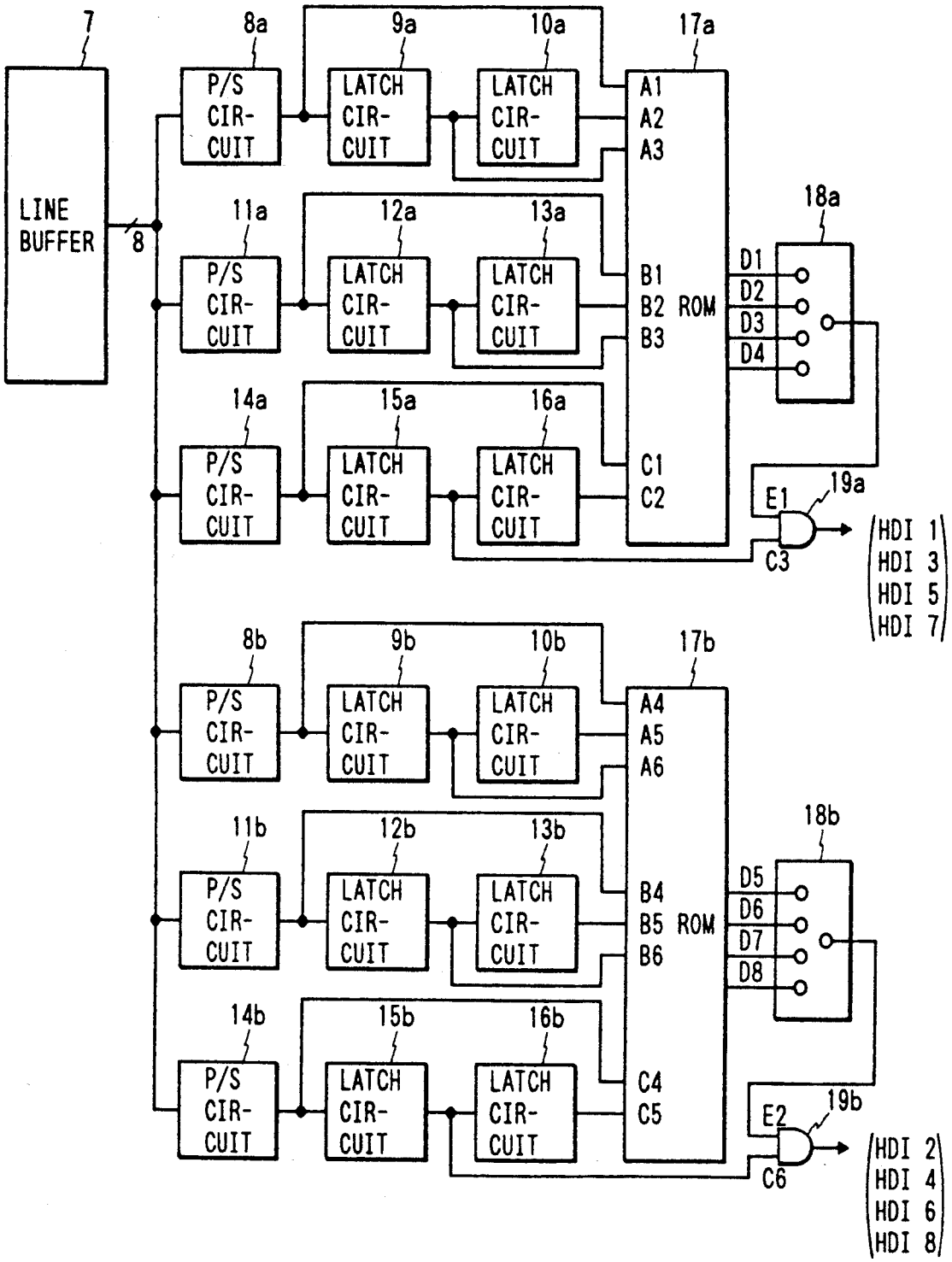
FIG. 15 PRIOR ART
FIG. 15 is a block diagram of one example of a reference circuit in the conventional printer.

FIG. 5 shows reference timing employed in the embodiment. The correcting data (energization times T1, T2 and T3) for the line to be printed are formed according to a reference method as shown in the part (b) of FIG. 6, and stored in the line buffer 7A. In the case where the aimed dot P is R256, the reference dots are made up of eight dots with the dot R257 of the next data input HDI2 being inclusive, and the energization time pattern (corresponding to the data stored in the ROM 25 in advance) is determined from the pattern (corresponding to the addresses in the ROM 25) of the reference dots. Similarly, in the case where the aimed dot P is R257 or R512, the reference dots are made up of eight dots, and the energization time pattern is determined from the pattern of the reference dots. When provision of the energization time pattern has been accomplished for one line (HDI1 through HDI8) the energization control is started. The energization time is determined in the same manner as in the prior art; that is, the determination is carried out as shown in FIG. 9. However, in this case, the adjusting energization time T4 is not used.

As was described above, in the embodiment of the invention, the energization time is controlled with the effect of heat of eight reference dots taken into account even for the end dot of each data input, with the result that the print quality is remarkably improved.

The embodiment has been described with reference to the thermal head of eight-inputs and four energization blocks; however, the technical concept of the invention can be equally applied to other thermal heads having more inputs and more energization blocks.

The reference dots may be dots adjacent to the aimed dots on the line immediately before the line to be printed and the line located two lines before the line to be printed. And not only the dots on the right and left side of the aimed dot, but also the dots next to those dots can be employed as reference dots, to achieve the object of the invention.

In the above-described embodiment, three different energization times T1, T2 and T3 are employed for the energization control of the aimed dot; however, the invention is not limited thereto or thereby. That is, the same effect can be obtained by employing a variety of energization time patterns.

As was described above, the printer of the invention comprises: the first hold means for holding at least data on dots adjacent to an aimed dot on a line to be printed; the second hold means for holding data on aimed dots on the line immediately before the line to be printed and on the line located two line before the line to be printed, and at least data on dots adjacent to the aimed dots on the line immediately before the line to be printed and the line located two lines before the line to be printed; the third hold means for holding correcting data formed according to the data held by the first and second hold means; and the control means for controlling the energization time of the aimed dot on the line to be printed, according to the correcting data. Hence, the printer of the invention is considerably high in print quality.

What is claimed is:

1. A printer which performs a printing operation by selectively energizing a plurality of heat generating resistance elements divided into plural energization blocks in a line, said printer comprising:

first storage means for storing at least data on dots adjacent to an aimed dot on a line to be printed;

second storage means for storing data on aimed dots on a line immediately before said line to be printed and on a line located two lines before said line to be printed, and at least data on dots adjacent to said aimed dots on said line immediately before said line to be printed and on said line located two lines before said line to be printed, said first and second storage means storing data for at least eight dots;

third storage means for storing correcting data formed according to said data stored by said first and second storage means; and control means for controlling an energization time of said aimed dot on said line to be printed, according to said correcting data, wherein the energization time of each dot on said line including each dot at opposite ends of said line is controlled by said control means according to said correcting data formed based on said data for at least eight dots.

2. A printer as claimed in claim 1, wherein said control means stores, in advance, an energization time pattern data corresponding to a pattern of reference dots.

* * * * *